US007762556B1

(12) United States Patent
Albenda

(10) Patent No.: US 7,762,556 B1
(45) Date of Patent: Jul. 27, 2010

(54) APPARATUS FOR PLAYING SPORTS-RELATED, TABLE AND FLOOR GAMES

(76) Inventor: Abe Albenda, 276 Exeter St., Brooklyn, NY (US) 11235

( * ) Notice: Subject to any disclaimer, the term of this patent is extended or adjusted under 35 U.S.C. 154(b) by 0 days.

(21) Appl. No.: 12/466,898

(22) Filed: May 15, 2009

Related U.S. Application Data

(60) Provisional application No. 61/127,692, filed on May 15, 2008.

(51) Int. Cl.
*A63F 9/00* (2006.01)

(52) U.S. Cl. ..... 273/309

(58) Field of Classification Search ..... None
See application file for complete search history.

(56) References Cited

U.S. PATENT DOCUMENTS 2,263,115 A * 11/1941 Winter ..... 273/108.4
2,824,739 A * 2/1958 Frank ..... 273/126 R
3,887,187 A * 6/1975 Crossman et al. ..... 273/126 A
3,968,968 A * 7/1976 Peterson ..... 473/473
4,284,277 A * 8/1981 Leonard et al. ..... 473/471
4,759,520 A 7/1988 Levine
4,841,587 A * 6/1989 Carter et al. ..... 5/419
4,871,170 A * 10/1989 Carini ..... 273/126 R
5,016,878 A * 5/1991 Hay et al. ..... 273/108.51
5,104,124 A * 4/1992 Bernard et al. ..... 273/317.3
5,224,710 A * 7/1993 Feokhari ..... 273/247
5,275,401 A * 1/1994 Llorens ..... 273/108.51
5,317,823 A 6/1994 Brunt, II
5,562,520 A 10/1996 Pridonoff et al.
5,613,683 A * 3/1997 Ying et al. ..... 273/317.1
5,882,007 A 3/1999 Gay
5,975,526 A 11/1999 Hoffman
6,073,283 A * 6/2000 Zheng ..... 5/417
6,203,017 B1 3/2001 Schultz
6,457,711 B1 10/2002 Baulesh
6,557,192 B2 * 5/2003 Zheng ..... 5/413 R
6,634,646 B2 10/2003 Wolpert et al.
6,682,070 B1 1/2004 Rosenfeld et al.
7,004,465 B2 2/2006 Keith
7,156,396 B1 1/2007 Voden
7,287,781 B1 * 10/2007 Hathaway ..... 283/2
7,451,709 B2 11/2008 Swartfager et al.
2004/0148832 A1 8/2004 Albenda
2007/0102384 A1 5/2007 Albenda

* cited by examiner

*Primary Examiner*—Gene Kim
*Assistant Examiner*—Dolores Collins
(74) *Attorney, Agent, or Firm*—Brian Roffe

(57) ABSTRACT

Apparatus for playing sports-related, table and floor games includes a single sheet of material having a front surface layer defining a smooth exposed playing surface and a rear surface layer, and defines left and right center panels, a spine panel section arranged therebetween, left and right side panel sections connected to the left and right center panels respectively, and left and right longitudinal edge panels connected to the left and right side panel sections, respectively. Cuts extend through the front and rear surface layers in lateral edge portions between the longitudinal edge panels and adjacent side panel sections, and separation lines are present between the panels and panel sections to enable the panels and panel sections to pivot relative to one another to allow folding. A stabilizing structure forms walls perpendicular to the smooth playing surface to provide a playing structure. Game accessories associated with the sheet enable game-play.

20 Claims, 6 Drawing Sheets

APPARATUS FOR PLAYING SPORTS-RELATED, TABLE AND FLOOR GAMES

CROSS REFERENCE TO RELATED APPLICATION

This application claims priority under 35 U.S.C. §119(e) of U.S. provisional patent application Ser. No. 61/127,692 filed May 15, 2008, which is incorporated by reference herein.

FIELD OF THE INVENTION

The present invention relates generally to portable sports apparatus and more particularly to a portable apparatus that can be used to play a variety of sports-related games, table games and/or floor games and can be folded up for storage and carrying.

The present invention also relates to a portable sports apparatus that provides a smooth playing surface that enables a variety of games to be played thereon, yet is capable of being folded or collapsed into a significantly smaller configuration than the playing configuration.

BACKGROUND OF THE INVENTION

Children enjoy playing sports or sports-related games. Some games may be designed to be suited for particular age groups while others incorporate various design elements that enable the games to become more challenging as the child develops. In addition to be a fun activity, playing games assists in the development of a child's coordination skills, such as vision, depth perception, aim, and hand/eye coordination.

Often however, sports-related games are large and not portable and difficult to store. For example, there are air hockey tables, nok-hockey boards and the like which are rigid structures and impractical to be easily moved from one location to another.

Some game tables are portable. One such example is U.S. Pat. No. 6,634,646 (Wolpert et al.) which describes a portable game table having a protective outer surface when in the closed position. The portable game table includes a game table having an outer surface and a case configured to attach to the game table. A portion of the outer surface of the game table includes a portion of the protective outer surface. The game table may be configured to have a game played thereon, such as football, billiards and air hockey. Another example of a game table is U.S. Pat. No. 7,156,396 (Voden) which has a plurality of table top portions interconnected with at least one hinge and movable between an extended position and a folded position. At least one rail is configured to be removably mounted to the plurality of table top portions and configured to removably secure at least one game template to the plurality of table top portions. However, these portable game tables are still bulky and difficult to carry.

The inventor has recognized these problems with prior art portable game tables and deems it to be beneficial to provide apparatus having a preferably smooth playing surface for playing sports-related games that are portable and foldable or collapsible and can easily be moved from one location to another and set up and each location as desired by the players, and moreover can be stored in the folded or collapsed configuration.

OBJECTS AND SUMMARY OF THE INVENTION

It is an object of the present invention to provide new and improved apparatus for playing sports-related games that are portable and can easily be moved from one location to another and set up and each location as desired by the players, and moreover can be stored in the folded or collapsed configuration.

In order to achieve these objects and others, a first embodiment of an apparatus for playing sports-related games, tales games and/or floor games in accordance with the invention includes a single sheet of material comprising a front surface layer, a rear surface layer and a plurality of connected panels. The panels includes a left center panel, a right center panel, a spine panel section arranged between the left and right center panels, a left side panel section connected to the left center panel, a right side panel section connected to the right center panel, a left longitudinal edge panel connected to the left side panel section and a right longitudinal edge panel connected to the right side panel section. Each of the left center panel, the right center panel, the spine panel section, the left side panel section, the right side panel section, the left longitudinal edge panel and the right longitudinal edge panel has a main body portion and lateral edge portions on opposite sides of the main body portion. The sheet includes cuts extending through both the front and rear surface layers in the lateral edge portions between the left longitudinal edge panel and the left side panel section, between the right longitudinal edge panel and the right side panel section, between the left longitudinal edge panel and the left side panel section and between the right longitudinal edge panel and the right side panel section. The sheet further includes separation lines between the panels and panel sections to enable the panels and panel sections to pivot relative to any adjacent panels. A stabilizing structure enables the formation of walls extending perpendicular to a main, smooth playing surface, these walls being considered side walls and end walls. Specifically, the stabilizing structure forms the walls by selectively maintaining the longitudinal edge portions in a position perpendicular to the main body portion of the left center panel, the right center panel, the spine panel section, the left side panel section and the right side panel section, and also maintains the lateral edge portions of the left center panel, the right center panel, the spine panel section, the left side panel section and the right side panel section in a position perpendicular to the main body portion of the left center panel, the right center panel, the spine panel section, the left side panel section and the right side panel section. The apparatus also includes at least one game accessory formed integral with or removably attached to the sheet to enable playing of a game. The stabilizing structure enables the sheet to assume a three-dimensional state in which the game is playable using the sheet with the integrally formed side and end walls.

The unitary construction of the apparatus from the sheet enables a very smooth playing surface to be formed, without discontinuities caused by, for example, physical hinges that connect two parts of a playing surface together. That is, the upper surface of the main body portion of the left center panel, the right center panel, the spine panel section, the left side panel section and the right side panel section formed in combination a smooth playing surface.

BRIEF DESCRIPTION OF THE DRAWING

The invention, together with further objects and advantages thereof, may best be understood by reference to the following description taken in conjunction with the accompanying drawings, wherein like reference numerals identify like elements and wherein.

DETAILED DESCRIPTION OF THE INVENTION

Figure 1:
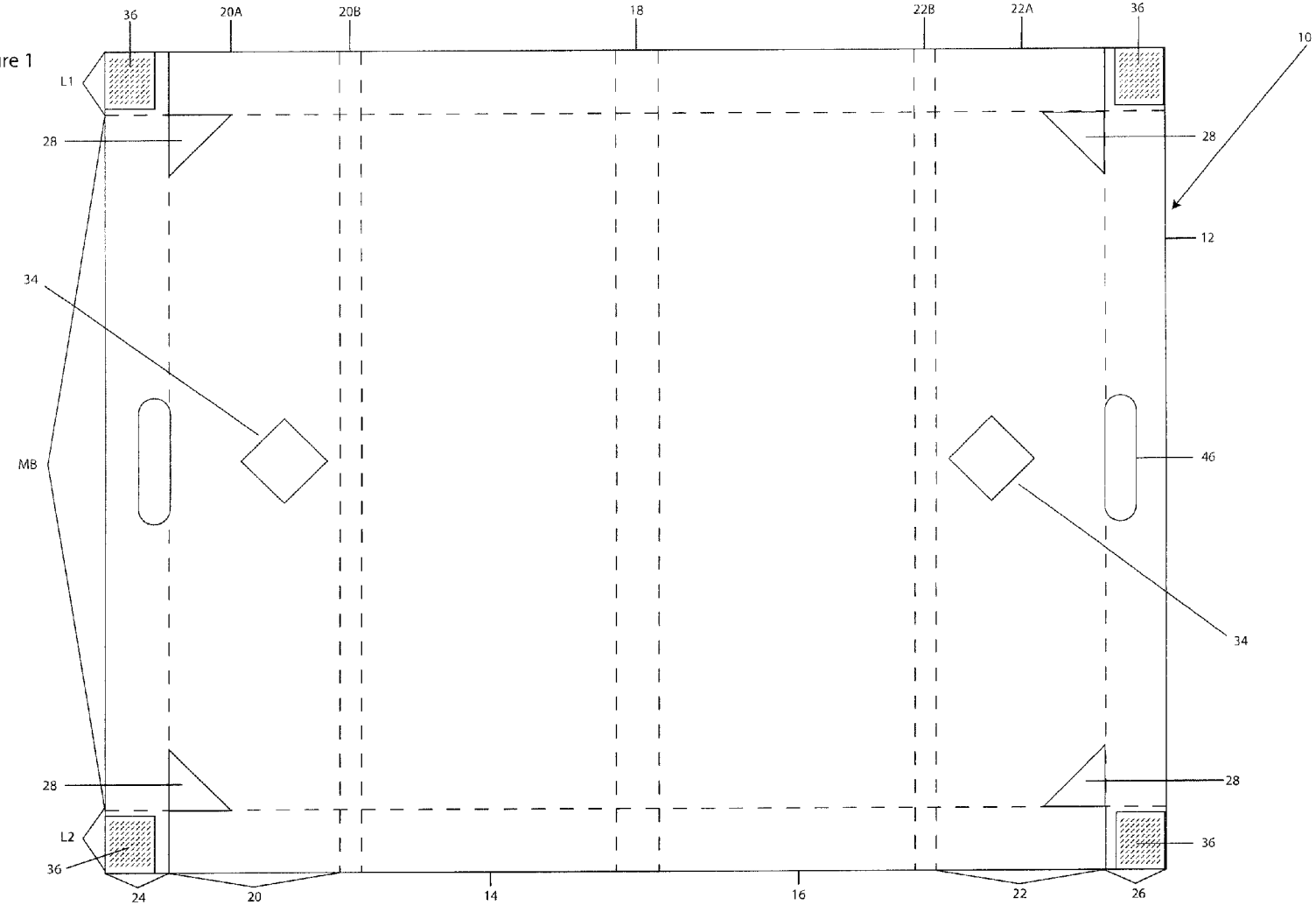
FIG. 1 is a front, perspective view of a portable apparatus for playing sports-related games, table games and/or floor games in accordance with the invention in an open configuration prior to modification of the sheet into a playing configuration or mode.

Referring to the accompanying drawings wherein like reference numerals refer to the same or similar elements, FIGS. 1-6 show an apparatus for applying sports-related games in accordance with the invention which is designated generally as 10 and comprises a single sheet 12 of corrugated plastic or other appropriate material separated into a plurality of connected panels, namely, a left center panel 14, a right center panel 16, a spine panel section 18 arranged between the left and right center panels 14, 16, a left side panel section 20 connected to the left center panel 14, a right side panel section 22 connected to the right center panel 16, a left longitudinal edge panel 24 connected to the left side panel section 20 and a right longitudinal edge panel 26 connected to the right side panel section 22. The left and right longitudinal edge panels 24, 26 provide the end walls of the apparatus 10.

The left center panel 14 is pivotally coupled to the right center panel 16 via the spine panel section 18 (i.e., an indirect pivotal coupling) so that the left and right center panels 14, 16 are rotatable relative to one another. The spine panel section 18 may be formed from a single section, or alternatively two sections. The left side panel section 20 comprises two sections 20A and 20B and the right side panel section 22 comprises two sections 22A and 22B. Section 20B may alternatively be considered as part of the left center panel 14 while section 22B may alternatively be considered as part of the right center panel 16.

Each of the left center panel 14, right center panel 16, spine panel section 18, left side panel section 20, right side panel section 22, left longitudinal edge panel 24 and right longitudinal edge panel 26 includes a main body portion (in the portion designated MB) and first and second lateral edge portions connected to and on opposite sides of the main body portion (in the portions designed L1 and L2). The lateral edge portions L1 and L2 provide the side walls of the apparatus 10.

Figure 2:
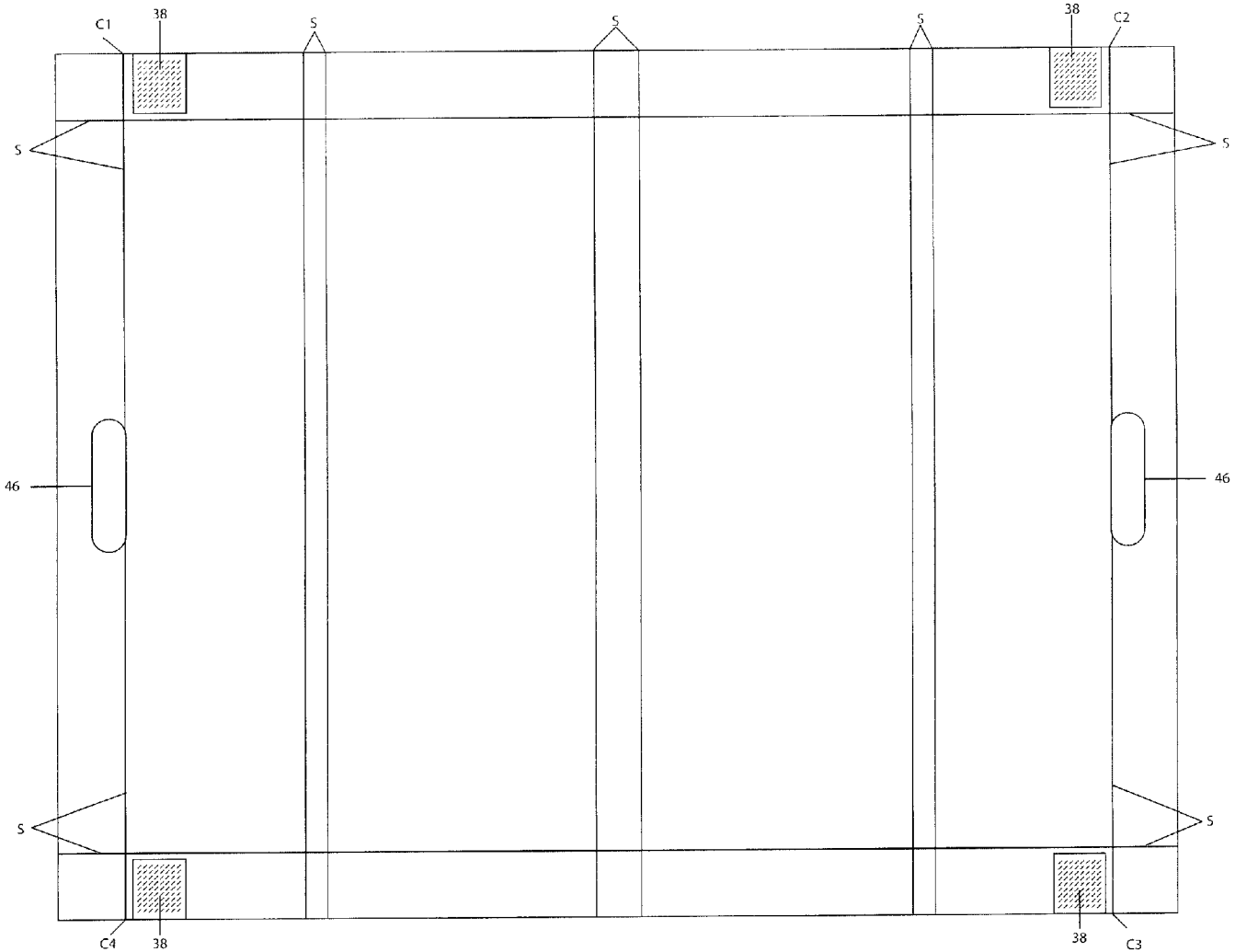
FIG. 2 is a rear view of one embodiment of the portable apparatus for playing sports-related games shown in FIG. 1 showing cuts and separation lines or scores that allow the sheet to be folded into the playing configuration or mode.
Figure 3:
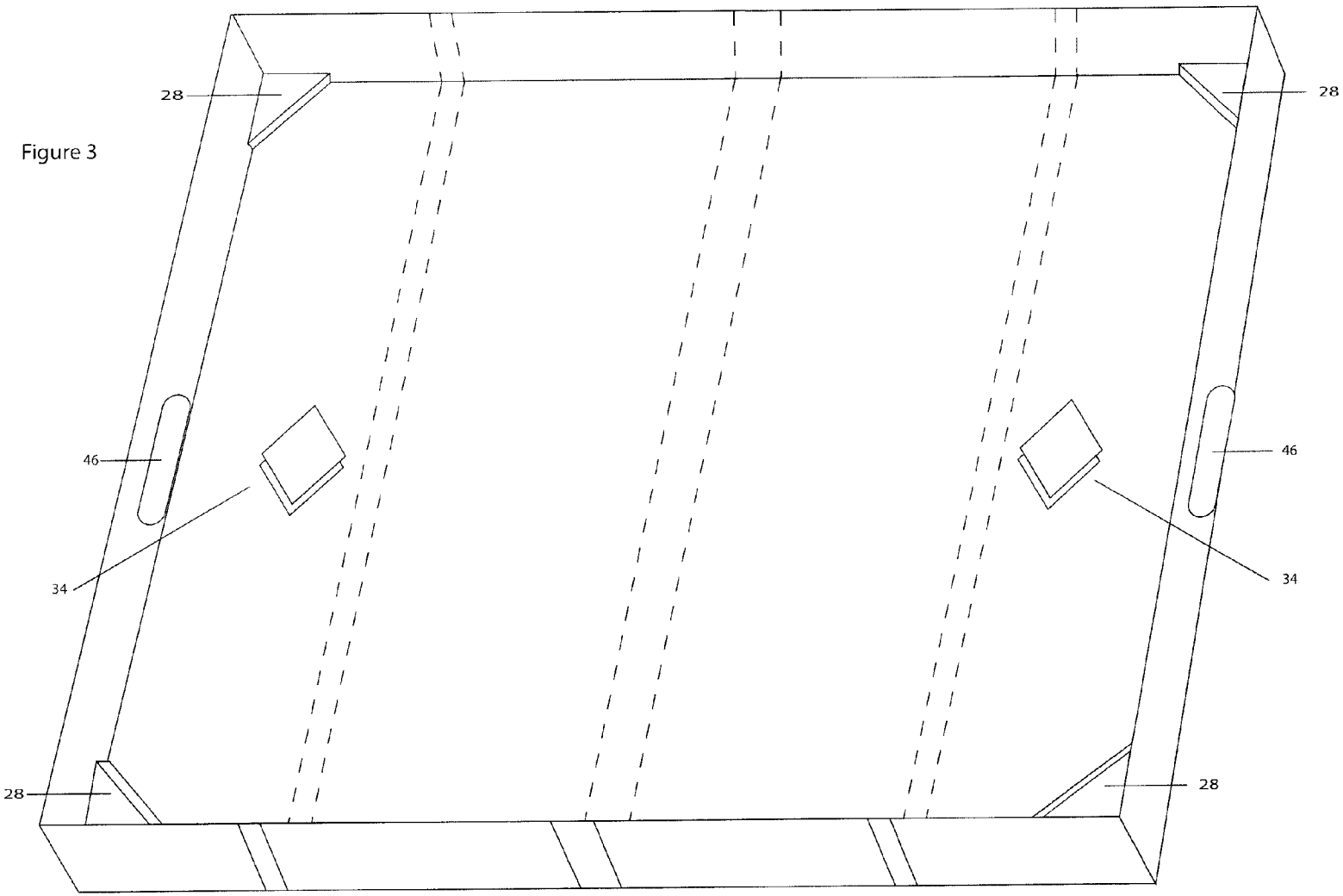
FIG. 3 is a perspective view of the portable apparatus shown in FIG. 1 in the playing configuration.
Figure 4:
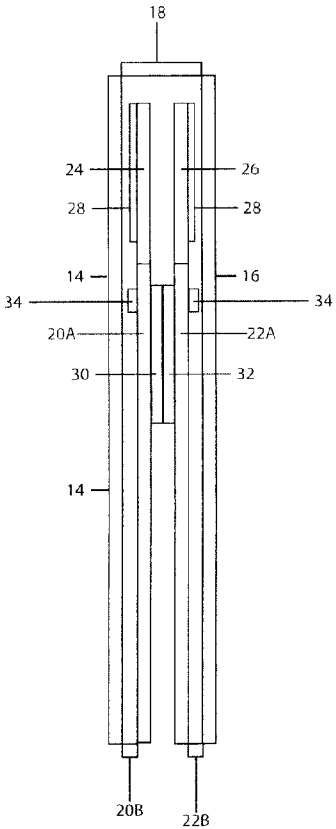
FIG. 4 is a side view of the portable apparatus shown in FIG. 1 in a compact, carrying and storage configuration or mode.

The various panels, panel sections, body portions and lateral edge portions are formed to enable the apparatus 10 to convert from an entirely planar form as shown in FIGS. 1 and 2 into a three-dimensional form shown in FIG. 3. Specifically, the sheet 12 is cut through, i.e., from one side of the sheet 12 to the other side of the sheet at four locations C1, C2, C3 and C4 as shown in FIG. 2, and separation lines S are formed at the other locations between each pair of adjacent panel, panel sections, body portions, lateral edge portions and longitudinal edge panels. Cut C1 is situated in the lateral edge portion L1 between the left longitudinal edge panel 24 and the left side panel section 20, cut C2 is situated in the lateral edge portion L1 between the right longitudinal edge panel 26 and the right side panel section 22, cut C3 is situated in the lateral edge portion L2 between the left longitudinal edge panel 24 and the left side panel section 20 and cut C4 is situated in the lateral edge portion L2 between the right longitudinal edge panel 26 and the right side panel section 22.

The separation of the sheet 12 into the different panels, panel sections, body portions, lateral edge portions and longitudinal edge panels is designed to enable the sheet 12 to be easily folded between the flat configuration shown in FIGS. 1 and 2 and the operative, playing configuration shown in FIG. 3. Moreover, the sheet 12 can also be folded into a carrying, transport and/or storage configuration shown in FIG. 4. In this configuration, the apparatus can easily be carried by a player between locations, it can more easily shipped by a manufacturer or distributor to customers, and more easily stored. Additionally, the availability of the compact configuration is beneficial for storage and display at stores and other retail locations.

To maintain the sheet 12 in its playing configuration shown in FIG. 3 including walls that extend at an angle to the playing surface, e.g., perpendicular thereto, a stabilizing mechanism is provided to form and maintain the side and end walls. These side wall and end walls are often necessary depending on the game being played on the smooth surface of the apparatus 10, e.g., the walls serve to keep balls and pucks and other moving or movable object of the game in play on the playing surface. Specifically, the stabilizing mechanism maintains the longitudinal edge portions 24, 26 (end walls) in a position perpendicular to the main body portion of the left center panel 14, right center panel 16, spine panel section 18, left side panel section 20 and right side panel section 22, and also maintains the lateral edge portions L1, L2 (side walls) of the left center panel 14, right center panel 16, spine panel section 18, left side panel section 20 and right side panel section 22 in a position perpendicular to the main body portion of the left center panel 14, right center panel 16, spine panel section 18, left side panel section 20 and right side panel section 22. This stabilizing mechanism may have several forms. In the illustrated embodiment, one of hook and loop fasteners, e.g., VELCRO™, is placed in an area 36 on the front surface of the sheet 12 in the lateral edge portions L1, L2 of the longitudinal edge panels 24, 26 (see FIG. 1) and the other of the hook and loop fasteners is placed in an area 38 on the rear surface of the sheet 12 in the lateral edge portions L1, L2 of the left and right side panel sections 20, 22 along the edge adjacent the left and right longitudinal edge panels 24, 26 (see FIG. 2). In this manner, mating of the areas 36, 38 of hook and loop fasteners causes the sheet 12 to assume a three-dimensional configuration shown in FIG. 3.

The foldings between the various configurations may be either an inward folding wherein the lateral edges of the sheet 12 are brought inward to be situated between other parts of the sheet 12 or an outward folding wherein the lateral edges are not brought between other parts of the sheet 12. The outward folding allows for various sized panels substantially without dimensional limitations.

The sheet 12 may be formed from opposed substantially planar layers of plastic or other appropriate material connected by ribs to thereby define cavities. The planar layers may be substantially coextensive with one another, although portions of one or both planar layers may be removed.

To form the different panels, panel sections, body portions, lateral edge portions and longitudinal edge panels, vertically extending separation lines S are formed in the planar layer on the rear side of the sheet 12, one separation line S will be present between each adjacent pair of panels 14, 16, panel sections 20, 22 and lateral edge portions 24, 26 (see FIG. 2). The separation lines S extend from the bottom of the sheet 12 to the top of the sheet 12 to thereby partition the sheet 12 into the panels or horizontal sections (all of the separation lines but the separation lines between the panel section 20 and the longitudinal edge portion 24 and the panel section 22 and the longitudinal edge portion 26 which extend only alongside the main body portion and have a through cut C1, C2, C3, C4 in the lateral edge portions L1 and L2—see FIG. 2).

The sheet 12 may be formed with the ribs in either a vertical orientation, i.e., extending vertically from a lower edge of the sheet 12 to an upper edge of the sheet 12, or in a horizontal orientation, i.e., extending horizontally from a left edge of the sheet 12 to the right edge of the sheet 12. In the latter configuration, the separation lines S are constituted by a cut through the rear planar layer of the sheet 12 and horizontally extending ribs. However, if the ribs were in a vertical orientation, then the separation lines S would be cuts in the rear planar layer between a pair of adjacent ribs. The separation lines S thus can be formed either parallel to the corrugation (between adjacent pairs of ribs) or perpendicular to the corrugation (through the ribs).

Instead of cutting the rear planar layer of the sheet 12 to form the separation lines S, another way to form the separation lines S is to groove or crush a portion of the sheet 12, i.e., press the rear planar layer against the front planar layer on the front side of the sheet 12 with the result that the portion of the ribs therebetween are crushed, and then heating the crushed portion to cause the rear planar layer and crushed ribs to melt onto the front planar layer. In this case, the sheet 12 is formed from opposed front and rear, substantially planar layers of material connected by parallel ribs to define cavities.

By forming the separation lines S in conjunction with only the rear planar layer of the sheet 12, the panels, panel sections, body portions, lateral edge portions and longitudinal edge panels remain attached to one another via the front planar layer of the sheet 12. Fold or hinge lines are thus formed in the front planar layer of the sheet 12 opposite the separation lines in the rear planar layer (these fold or hinge lines being represented by the dotted lines in FIG. 1). To improve the flexibility of the panels about the fold lines, the fold lines may be scored, which is particularly preferable when the separation lines S are formed by the crushing technique. This enables the panels, panel sections, body portions, lateral edge portions and longitudinal edge panels to pivot forward around the fold lines to thereby enable the compact configuration shown in FIG. 4 to be obtained, and still maintain the flat, smooth playing surface provided by the sheet 12.

It is conceivable that the sheet 12 may be partitioned into a different number of panels and/or panel sections than shown in FIGS. 1-4 by forming the separation lines 30 and fold lines in the rear and front planar layers, respectively, at predetermined locations to arrive at the desired number and size of panels. The locations would be selected to enable folding of the sheet 12 about the fold lines into a compact configuration.

The single sheet 12 may be formed from one or more sturdy materials known to those skilled in the art including but not limited to plastic, cardboard, foam or treated paper. One suitable plastic is polypropylene. The sheet 12 can be formed to be entirely clear, transparent or translucent, or with a combination of clear, transparent and/or translucent portions. The sheet can be coated, e.g., made of cardboard with a coating. It can also be made of grooved plastic.

Preferably, the exposed surface of the front surface layer of the sheet 12 on which the game is to be plated is smooth while the texture of the rear surface layer of the sheet 12 is basically immaterial. The smoothness of the exposed surface of the front surface layer is often necessary to provide for a playable game, i.e., for a ball or other movable piece to slide or otherwise move along the playing surface. Importantly, in a preferred embodiment, the sheet 12 has a generally uniform structure across its width and height and is formed from a single integral substrate. Thus, the single sheet 12 not only forms the base of the game to be played thereon but also the sides which are integral with the base, i.e., as shown in FIG. 3, the sides formed by the longitudinal edge portions 24 and 26 and the lateral edge portions L1 and L2 are perpendicular to the main body portion MB of the left center panel 14, right center panel 16, spine panel section 18, left side panel section 20 and right side panel section 22.

The front planar layer of the sheet 12 may also be colored in various colors, and advantageously provided with different designs for the sports-related game or games to be played using the apparatus 10. If so desired, different apparatus 10 could be formed with different patterns of games on the front planar layer of the sheet 12, e.g., a first design for bowling, a second design for bocce, etc.

Optionally, the front planar surface layer may be formed from an erasable and washable material, which would enable it to be used for multiple, different sports-related games.

The size of the sheet 12 and the various panel and panel sections formed thereby is varied depending on the particular games or games to be played using the apparatus 10. Some games have standard sizes while others can vary. It is envisioned that inserts may be used to adjust a larger playing surface used for one game to a smaller playing surface is needed for a different game.

To enable use of the apparatus 10 for playing various games, attachments or accessories related to the game may be removably or permanently attached to the sheet 12. As shown in FIG. 1, for a game of nok-hockey, corner deflectors 28 are attached to the left side panel section 20 and right side panel section 22 between the main body portion MB of the longitudinal edge portions 24, 26 and the lateral edge portions L1, L2 of the left side panel section 20 and right side panel section 22. Moreover, a goal blocker 34 is arranged on the left and right side panel sections 20, 22 in front of an opening 46 that constitutes the goals for each player.

The deflectors 28 and goal blockers 34, or any other accessories used in other sports-related games formed by the apparatus 10, may be attached to the sheet in a variety of different ways. On way is to use hook and loop-type fasteners with one fastener being attached to the sheet 12 and other being attached to the accessory. Another way is to use tongue and groove attachment structure. In either case, the height of the accessories may be the same as or smaller than the height of the sections 22A, 22B to enable the accessories to be retained in connection with the sheet 12 even when the apparatus 10 is in its compact, folded configuration shown in FIG. 4.

Figure 7:
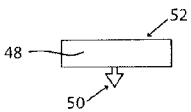
FIG. 7 is a side view of an accessory for use with the sheet shown in FIG. 5.

Additional attachment mechanisms for attaching the accessories to the sheet 12 include the use of snaps, one part of which is placed on the accessory and the mating part on the sheet 12, clips, hooks, slots and the like. Also, the sheet 12 may be provided with holes at appropriate locations and the accessories with pegs that can be pressed into and securely retained in the holes (see holes 44 in FIG. 5 and accessory 52 in FIG. 7 having a game portion 48 and a peg 50). Decals or other printed matter may be arranged on the front surface of the sheet 12 if needed for any particular game played with the apparatus, e.g., a scoring triangle for shuffleboard. Similarly, printed matter may be provided on the front surface of the sheet 12 by a silk screening technique or other comparable technique.

Figure 5:
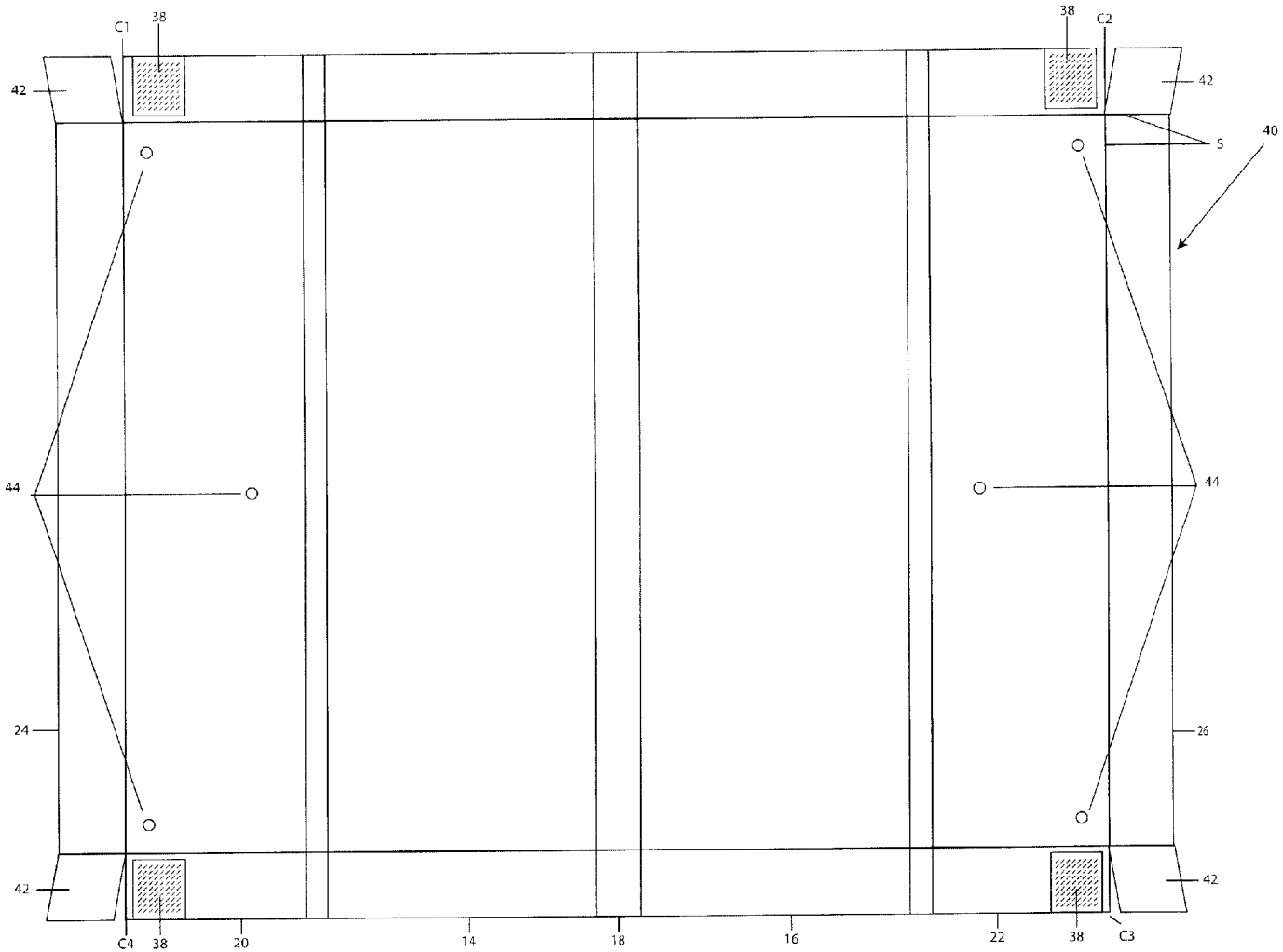
FIG. 5 is a rear view of the sheet of another embodiment of the portable apparatus for playing sports-related games showing cuts and separation lines or scores that allow the sheet to be folded into the playing configuration or mode.
Figure 6:
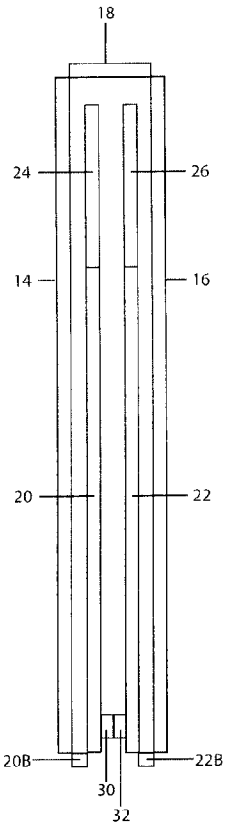
FIG. 6 is a side view of the portable apparatus shown in FIG. 5 in a compact, carrying and storage configuration or mode.

The embodiment shown in FIGS. 5 and 6 is similar to that shown in FIGS. 1-4 and the same reference numerals refer to the same elements. However, in this embodiment, the left side panel section 20 consists of a single panel and the right side panel section 22 consists of a single panel, i.e., instead of a pair of separation lines between panel section 20A and the left center panel 14 as shown in FIG. 1, there is a single separation line resulting the elimination of the panel section 20B. Similarly, instead of a pair of separation lines between panel section 22A and the right center panel 16 as shown in FIG. 1, there is a single separation line resulting the elimination of the panel section 22B.

FIG. 5 also clearly shows the effect of the cuts C1, C2, C3, C4 in the lateral edge portions L1, L2 between the longitudinal edge panels 24, 26 and the adjacent left and right side panel sections 20, 22 to form flaps 42.

The holes 44 in the sheet 12 may be arranged in a specific pattern to enable different accessories or groups of accessories to be removably connected to the sheet 12 to enable one of a plurality of different games to be alternatively played with the same sheet 12. The player would then remove one group of accessories used to play a first game, install a second group of accessories in a different group of holes and then be able to play a second game different from the first game.

Although FIGS. 1-6 show an apparatus 10 for use as a nok-hockey game, similar apparatus may be designed to other games, such as but not limited to, bowling, bocce, table tennis, golf, shuffleboard, basketball, billiards, pool and football. Basically, the apparatus can be designed to provide a playing surface for any and all known or subsequently developed games that require a sturdy, self-standing form, optionally with a specific pattern of markings that can be formed on the front surface layer of the sheet 12 or with accessories that can be placed at the required locations on the sheet 12.

The accessories may also be attached to the sheet 12 using ties, and possibly at locations other than their playing location to facilitate better storage of the accessories in conjunction with the sheet 12.

In some games, it may be necessary or desired to provide a separate insert that is placed into the three-dimensional structure formed by the sheet 12. For example, for bowling, an insert may be provided that frictionally engages the side walls of the apparatus 10, .e., the side walls formed by the longitudinal edge portions 24 and 26 and the lateral edge portions L1 and L2. This insert would have a mechanism to enable placement of ten pins at one end and an opening to enable the ball used for bowling to be returned to the player at the opposite end. The insert may therefore be angled to enable this effect.

The apparatus 10 may be provided with several optional features to enhance its use. One feature is an attachment mechanism to maintain the apparatus 10 in the compact configuration shown in FIG. 4. One such attachment mechanism comprises a strip 30 of hook-type fasteners arranged on the outer surface of the rear planar layer of the section 20A of the panel section 20 and a strip 32 of loop-type fasteners arranged on the outer surface of the rear planar layer of the section 22A of the panel section 22 (see FIG. 4). During closing of the apparatus, the sections 20A and 22A can be brought close to one another to cause engagement of the strips 30, 32 and thus attachment of the left and right side panel sections 20,22 together. This would maintain the apparatus 10 in the compact configuration shown in FIG. 4.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention. In particular, all of the concepts disclosed in U.S. patent application Ser. Nos. 10/723,077 filed Nov. 26, 2003 and 11/609,207 filed Dec. 11, 2006 for display and presentation boards may be incorporated into the apparatus in accordance with the invention. These applications and their entire disclosure are incorporated by reference herein.

The invention claimed is:

1. A portable apparatus for playing sports-related games, table games and floor games, comprising:

a single sheet of material comprising a front surface layer, a rear surface layer and a plurality of connected panels, said front surface layer having a smooth exposed surface on which the game is played, said panels including a left center panel, a right center panel, a spine panel section arranged between said left and right center panels, a left side panel section connected to said left center panel, a right side panel section connected to said right center panel, a left longitudinal edge panel connected to said left side panel section and a right longitudinal edge panel connected to said right side panel section, each of said left center panel, said right center panel, said spine panel section, said left side panel section, said right side panel section, said left longitudinal edge panel and said right longitudinal edge panel having a main body portion and lateral edge portions on opposite sides of said main body portion, said sheet including cuts extending through both said front and rear surface layers in said lateral edge portions between said left longitudinal edge panel and said left side panel section, between said right longitudinal edge panel and said right side panel section, between said left longitudinal edge panel and said left side panel section and between said right longitudinal edge panel and said right side panel section, said sheet further including separation lines between said panels and panel sections to enable said panels and panel sections to pivot relative to any adjacent panels; and a stabilizing structure that causes walls perpendicular to said main body portion to be formed from said sheet and maintains said walls in positions perpendicular to said main body portion, said stabilizing structure being arranged to retain said longitudinal edge portions in a position perpendicular to said main body portion of said left center panel, said right center panel, said spine panel section, said left side panel section and said right side panel section, and also maintain said lateral edge portions of said left center panel, said right center panel, said spine panel section, said left side panel section and said right side panel section in a position perpendicular to said main body portion of said left center panel, said right center panel, said spine panel section, said left side panel section and said right side panel section, such that said walls are formed by said longitudinal edge portions and said lateral edge portions of said sheet; and at least one game accessory formed integral with or removably attached to said sheet to enable playing of a game, said at least one accessory being related to the game, wherein said stabilizing structure causes said walls to be formed and thereby enables said sheet to assume a three-dimensional state in which the game is playable using the sheet, said walls preventing movable objects used in the game from leaving the smooth playing surface.

2. The apparatus of claim 1, wherein said stabilizing structure comprises an attachment mechanism arranged on said front surface of said sheet and said rear surface of said sheet.

3. The apparatus of claim 1, wherein said stabilizing structure comprises a first attachment part arranged in an area on said front surface of said sheet in said lateral edge portions of said longitudinal edge panels and a second, mating attachment part arranged in an area on said rear surface of said sheet in said lateral edge portions of said left and right side panel sections along edges adjacent said left and right longitudinal edge panels.

4. The apparatus of claim 1, wherein said at least one accessory comprises a decal formed integral with said sheet.

5. The apparatus of claim 1, further comprising an attachment mechanism for removably attaching said at least one accessory to said sheet.

6. The apparatus of claim 5, wherein said attachment mechanism comprises one of hook and loop fasteners arranged on said front surface of said sheet and the other of hook and loop fasteners arranged on said at least one accessory.

7. The apparatus of claim 5, wherein said attachment mechanism comprises a hole formed in said sheet and a peg arranged on said at least one accessory.

8. The apparatus of claim 1, wherein said separation lines constitutes cuts in said rear planar layer.

9. The apparatus of claim 1, wherein said separation lines constitutes a crushed, elongate portion of said rear planar layer which is melted onto said front planar layer.

10. The apparatus of claim 1, wherein said front planar layer includes fold lines formed opposite said separation lines.

11. The apparatus of claim 10, wherein said fold lines are partially cut through said rear planar layer.

12. The apparatus of claim 1, wherein said sheet is formed from opposed substantially planar layers of material connected by parallel ribs to define cavities.

13. The apparatus of claim 1, further comprising attachment means for maintaining said sheet in a folded, compact configuration with planar surfaces of said panels facing one another.

14. The apparatus of claim 1, further comprising an attachment system that maintains said sheet in a folded, compact configuration with planar surfaces of said panels facing one another.

15. The apparatus of claim 1, wherein said separation lines include fold lines between said longitudinal edge portions and said main body portion of said left center panel, said right center panel, said spine panel section, said left side panel section and said right side panel section, said stabilizing structure being arranged to form said walls from said longitudinal edge portions and perpendicular to said main body portion by maintaining said longitudinal edge portions in a folded state about said fold lines which allows for flat folding of the apparatus.

16. The apparatus of claim 1, wherein said separation lines include fold lines between said lateral edge portions and said main body portion of said left center panel, said right center panel, said spine panel section, said left side panel section and said right side panel section, said stabilizing structure being arranged to form said walls from said lateral edge portions and perpendicular to said main body portion by maintaining said lateral edge portions in a folded state about said fold lines which allows for flat folding of the apparatus.

17. The apparatus of claim 1, wherein said separation lines include:

first fold lines between said longitudinal edge portions and said main body portion of said left center panel, said right center panel, said spine panel section, said left side panel section and said right side panel section, said stabilizing structure being arranged to form said walls from said longitudinal edge portions and perpendicular to said main body portion by maintaining said longitudinal edge portions in a folded state about said first fold lines which allows for flat folding of the apparatus; and second fold lines between said lateral edge portions and said main body portion of said left center panel, said right center panel, said spine panel section, said left side panel section and said right side panel section, said stabilizing structure being arranged to form said walls from said lateral edge portions and perpendicular to said main body portion by maintaining said lateral edge portions in a folded state about said second fold lines which allows for flat folding of the apparatus.

18. The apparatus of claim 1, wherein said stabilizing structure is fixed to said sheet.

19. The apparatus of claim 1, wherein said stabilizing structure comprises first and second mating arrangement, both of which are arranged on said sheet so that when mating, said stabilizing structure causes said walls to form and when not mating, said sheet can assume a planar form.

20. The apparatus of claim 1, wherein said stabilizing structure is arranged to have a first condition in which it causes said walls to form when said sheet is in an unfolded state and a second condition in which it is folded together with said sheet while said sheet has a substantially planar form.

* * * * *